US008042324B2

(12) United States Patent
Griesshammer et al.

(10) Patent No.: US 8,042,324 B2
(45) Date of Patent: Oct. 25, 2011

(54) APPARATUS AND METHOD FOR WINDING A ROVING ONTO A BOBBIN

(75) Inventors: Christian Griesshammer, Winterthur (CH); David Gehring, Winterthur (CH); Fabian Lehner, Zollikon (CH); Pascal Marti, Stafa (CH)

(73) Assignees: Maschinenfabrik Rieter AG, Winterthur (CH); Faserforschung Denkendorf, Winterthur (CH)

( * ) Notice: Subject to any disclaimer, the term of this patent is extended or adjusted under 35 U.S.C. 154(b) by 257 days.

(21) Appl. No.: 12/429,689

(22) Filed: Apr. 24, 2009

(65) Prior Publication Data

US 2009/0289141 A1 Nov. 26, 2009

(30) Foreign Application Priority Data

Apr. 25, 2008 (CH) ..... 0657/08

(51) Int. Cl.
*D01H 13/04* (2006.01)

(52) U.S. Cl. ..... 57/315

(58) Field of Classification Search ..... 57/315; 19/236; 242/470, 472.1, 472.2, 476.7
See application file for complete search history.

(56) References Cited

U.S. PATENT DOCUMENTS

| | | | | |
|---|---|---|---|---|
| 2,600,037 | A * | 6/1952 | West | 242/472.1 |
| 2,664,594 | A * | 1/1954 | Anderson | 242/472.2 |
| 4,669,260 | A * | 6/1987 | Saviolo | 57/331 |
| 7,661,259 | B2 * | 2/2010 | Griesshammer et al. | 57/209 |
| 2004/0098837 | A1 * | 5/2004 | Hartung | 19/236 |
| 2007/0193245 | A1 * | 8/2007 | Griesshammer et al. | 57/209 |

FOREIGN PATENT DOCUMENTS

| | | | |
|---|---|---|---|
| WO | WO 2004/042126 | A1 | 5/2004 |
| WO | WO 2005026421 | A1 * | 3/2005 |

* cited by examiner

*Primary Examiner* — Shaun R Hurley
(74) *Attorney, Agent, or Firm* — Dority & Manning, P.A.

(57) ABSTRACT

The invention relates to an apparatus for winding a roving provided with a protective twist onto a roving bobbin, containing a bobbin mounting for the rotatable mounting of a roving bobbin and a traversing device for traversing in the bobbin axial direction the roving to be wound. The traversing device comprises a driven pair of winding delivery rollers arranged directly in front of the roving bobbin and having a nip line through which the roving to be wound is guided.

16 Claims, 2 Drawing Sheets

APPARATUS AND METHOD FOR WINDING A ROVING ONTO A BOBBIN

FIELD OF THE INVENTION

The present invention relates to an apparatus for winding a draftable roving onto a bobbin, to an apparatus for producing a roving having a winding apparatus according to the invention, and to a method for producing a roving using a roving production apparatus according to the invention.

A winding apparatus for winding a roving according to the invention contains a bobbin mounting for the rotatable mounting of a roving bobbin and a traversing device for traversing in the axial direction of the bobbin the roving to be wound, in order to obtain a package according to instructions.

BACKGROUND

Roving machines serve for producing a roving which is used as a model for spinning into a fibre yarn, for example on a ring-spinning machine, a drawer sliver being drafted in a drafting arrangement of the roving machine, and this fibre composite subsequently acquiring a twist before it is wound as fibre stubbing, with a protective twist, onto a feed bobbin.

The slubbing serving as a model for ring-spinning machines is therefore usually produced from a drawer sliver which is drafted on a drafting arrangement of the roving machine, mostly on a double-apron drafting arrangement, and subsequently acquires a slight twist, so that this slubbing can be wound, free of distortion, onto a bobbin. The imparted twist should only be such that the cohesion of the fibre composite is sufficiently firm for winding and unwinding again and for the transport of the bobbins, so that no wrong drafts occur. On the other hand, in terms of distortion on ring-spinning machines, this twist must be so low as to give rise, in the further treatment process, to no draft faults which may be reflected, for example, in what are known as pull-throughs, yarn defects, dimensional unevennesses, imperfections or thread breaks.

To produce the slubbing, the roving machine uses is what is known as a flyer. This roving machine is equipped with a drafting arrangement and with a spindle for winding the flyer slubbing onto a roving tube by means of a flyer in order to support the slubbing with respect to the centrifugal force caused by the spindle rotational speeds. For this purpose, the roving emerging from the drafting arrangement is wound onto the roving bobbin-via the flyer rotating about a roving tube. The roving acquires a protective twist as a result of the rotational movement before it is deposited on the roving tube. For this purpose, the roving is guided by a flyer arm of the flyer and deposited on the roving body via a press finger on the flyer, the press finger being pressed against the roving winding body. Imparting the twist in the roving and winding the latter onto a roving tube take place, here, in one process step. For reasons concerned with the process, the roving tubes are oriented vertically.

The flyer is, particularly because of the winding, a complicated and costly machine in the spinning process. In addition, the conventional delivery capacity of a flyer is 20 to 40 meters per minute. However, this low production cannot be increased with regard to the winding system using flyers, since a higher speed is limited by the centrifugal force which the flyers must withstand.

Meanwhile, however, other forms of imparting the twist in roving machines are also known, which have in common the fact that a protective twist is applied to the roving in a twist-imparting member following the drafting arrangement, and the roving having a protective twist is subsequently supplied to a winding device. That is to say, imparting the protective twist and winding the roving take place in separate process steps and, correspondingly, in separate, that is to say functionally separated devices. Correspondingly, in such roving machines, other winding devices can be used which are akin, for example, to the conventional bobbin-winding concept.

Thus, for example, WO-A-2005/026421 describes a method for producing a roving, in which imparting the twist takes place pneumatically in a nozzle block, in a similar way to the airjet spinning method. The roving experiences a genuine twist as a result of rotating air vortices.

WO-A-2004/042126 likewise describes a pneumatic imparting of twist, but, here imparting the twist takes place according to the two-nozzle principle. That is to say, the twist-imparting member contains a first twisting chamber, through which the sliver is conducted and acquires a twist by means of airjets. In a second twisting chamber of the twist-imparting member, the sliver acquires an opposite twist, likewise by means of airjets, so that a false twist is imparted to the sliver.

Furthermore, Swiss Patent Application CH 00044/08 describes a twist-generating member in the form of false-twist elements, for example rubbing rollers, in which the sliver is provided alternately with S- and Z-twists and is subsequently combined automatically into a roving self-twine. The roving self-twine is wound onto a roving tube in a winding device. The roving self-twine is opened into individual roving fibre strands again only in the ring-spinning machine.

What the three roving production methods according to the abovementioned patent applications have in common is that twist generation takes place independently of the winding of the roving in functional terms. This makes it possible to use a winding apparatus for the roving which is not possible in the case of conventional flyers.

An especially suitable winding apparatus is guided by the known bobbin-winding machine in which yarn is transferred at high speed from the top onto a yarn bobbin.

Such a device contains a bobbin mounting, in particular a creel or a bobbin mandrel, for the rotatable mounting of a roving bobbin and also a traversing device for traversing the roving to be wound, in relation to the bobbin, in the axial direction of the bobbin. The roving may be deposited in a parallel-wound or cross-wound package, substantially higher traversing speeds being adopted in the latter winding method.

In contrast to the yarn, the roving has a considerably lower strength because of its low twist which is of course merely a protective twist. If, then, the roving is to be wound at high speed onto a roving tube, without wrong drafts or even roving breaks or later yarn breaks occurring, the take-over of conventional winding devices is unsuitable. Particularly in the region of the traversing device, considerable problems arise when roving is being wound and may lead to wrong drafts or even roving breaks.

SUMMARY OF THE INVENTION

An object according to the invention, therefore, is to propose a winding device for a roving machine, by means of which the roving can be wound at high speeds of up to 600 m per minute without wrong drafts or roving breaks, while as closely-packed a roving package as possible is to be deposited on the roving tube. Objects and advantages of the invention will be set forth in part in the following description, or may be obvious from the description, or may be learned through practice of the invention.

The object is achieved in that the roving-laying device comprises a driven pair of winding delivery rollers which are arranged directly in front of the roving bobbin and which have a nip line through which the roving to be wound can be guided in a nipping manner. The axis of rotation of the roving bobbin is preferably oriented horizontally. However, the axis of rotation of the roving bobbin may also be oriented in any other desired direction, in particular in the vertical direction.

The draftable roving has a specific strength which, on the one hand, allows later drafting in a drafting arrangement of a fine-spinning machine and, on the other hand, makes it possible to wind and unwind the roving and transport it to a drafting arrangement of a fine-spinning machine without wrong drafts. The strength is preferably achieved by means of a protective twist in the roving.

The roller axes of the pair of winding delivery rollers preferably run parallel to the axis of rotation of the roving bobbin. However, the roller axes may also be arranged in any other desired direction, in particular transversely or perpendicularly to the axis of rotation of the roving bobbin. The roller axes are preferably arranged perpendicularly or essentially perpendicularly to the running-in roving. The lower or the upper roller of the pair of winding delivery rollers is driven actively via corresponding drive means. The non-driven roller is designed as a pressure roller. The roving guide may be such that the roving emerging from the pair of winding delivery rollers loops over part of the circumference around the lower roller or upper roller of the pair of winding delivery rollers. However, the roving guide may also be such that the yarn to be wound does not loop around the upper or lower roller, but runs directly out of the nip to the winding point on the roving bobbin.

For the purpose of traversing the roving lay on the roving bobbin, the pair of winding delivery rollers may be designed to be traversable in the bobbin axial direction with or without the specific drive. The pair of winding delivery rollers may, in particular, be guided traversably on a carriage. According to an alternative embodiment, the traversing device contains a traversing member which precedes or follows the pair of winding delivery rollers and by means of which the roving can be traversed in the bobbin axial direction along the nip line of the pair of winding delivery rollers. This makes it necessary, however, that the roller axes of the pair of winding delivery rollers and of the roving bobbin run parallel to one another. The pair of winding delivery rollers here preferably extends over the longitudinal extent of the roving bobbin.

Basically, the roving bobbin may also be traversed while the roving to be wound is being guided onto the bobbin at a fixed point, that is to say via a fixed pair of winding delivery rollers. Furthermore, both the bobbin and the roving to be wound may also be traversed in one of the abovementioned ways. However, both of the abovementioned versions involve a larger moved mass, and therefore preferably only the roving-guiding element is guided traversably according to the invention.

The drive means of the pair of winding delivery rollers are preferably connected to a control loop for regulating the roving tension between the pair of winding delivery rollers and the roving bobbin. For the purpose of building up a roving tension between the pair of winding delivery rollers and the roving bobbin, the driven roller of the pair of winding delivery rollers and the roving bobbin preferably have different circumferential speeds.

One or both of the winding delivery rollers may bear against the outer circumference of the roving bobbin or touch this outer circumference. Since the roving bobbin and winding delivery rollers have different circumferential speeds, the bearing or contact pressure is only so high that a slip is possible on account of the different rotational speeds of the roving bobbin and of the winding delivery roller. Preferably, however, the rollers do not touch the roving bobbins or do not bear against these.

The roving bobbin may be driven directly, that is to say drive means drive a shaft forming the axis of rotation of the roving bobbin. The roving bobbin may also be driven indirectly via what is known as a winding roller. That is to say, drive means drive the winding roller, also called a drive roller, which, exerting a pressure force, bears against the roving bobbin and drives the latter by a frictional connection. The winding speed of the roving bobbin is controlled or regulated correspondingly via the winding-roller drive.

For the purpose of regulating the circumferential speed of the roving bobbin, means must be provided which make it possible either to measure the circumferential speed of the roving bobbin directly or to determine it via the bobbin diameter. The bobbin diameter, which changes during the winding process, can be determined, for example, via the bobbin lift-off. Lift-off means the distance over which the axis of rotation of the roving bobbin bearing against a pressure roller (for example, winding roller) is moved away from a pressure roller with an increasing bobbin circumference.

If the roving bobbin is driven directly, however, the roving bobbin preferably bears against what is known as a tacho roller which co-rotates at the circumferential speed of the roving bobbin. The tacho roller and roving bobbin consequently run at the same circumferential speed, so that, via the rotational speed of the tacho roller, the circumferential speed of the roving bobbin can be measured and fed into the control loop. The roving guide, then, may be such that the yarn to be wound loops round part of the circumference of the tacho or drive roller. However, the roving guide may also be such that the yarn to be wound does not loop around the tacho or drive roller, but runs directly to the winding point between the tacho or drive roller and the roving bobbin.

It is advantageous, however, if the roving length between the nip and the winding point is as small as possible. This is achieved, for example, in that, on the one hand, an attempt is made to bring the nip of the pair of winding delivery rollers as near as possible to the roving bobbin and, on the other hand, a partial looping of the roving on the tacho or drive roller and/or on the lower or upper roller of the pair of winding delivery rollers is provided.

In order to take into account the changing diameter of the roving bobbin in the winding process and nevertheless to ensure sufficient bearing force between the roving bobbin and drive roller or tacho roller, either the roving bobbin or the drive roller or tacho roller must be mounted pivotably or displaceably via a corresponding device so as to exert a bearing force on the counter element. The bearing force is, for example, a restoring force exerted on the counter element by a restoring element, for example a spring. If the roving bobbin is driven by a drive roller, the roving bobbin is preferably guided pivotably or displaceably, for example, via the creel. If the roving bobbin is driven directly, the tacho roller or the pressure roller, mentioned below, is preferably mounted pivotably or displaceably.

In a special embodiment of the invention, a rotatably mounted pressure roller bears against the roving bobbin, the pair of winding delivery rollers and the pressure roller being mounted rotatably directly or indirectly on the first guide means and being mechanically coupled to one another via these, and the first guide means being mounted pivotably or displaceably with respect to the roving bobbin, so that, with an increasing bobbin diameter, the pair of winding delivery rollers can be displaced or pivoted, together with the pressure roller, jointly in the radial direction of the roving bobbin. That is to say, the mechanical coupling is expediently a rigid coupling. The pair of winding delivery rollers and the pressure roller are rotatably mounted directly or indirectly on the first guide means.

Furthermore, first restoring means are provided, by which the pressure roller transmits a bearing pressure to the roving bobbin. The first guide means are such that, with an increasing bobbin diameter, the pair of winding delivery rollers are raised, together with the pressure roller, correspondingly to the increase in circumference. In this case, however, a restoring force is always exerted on the pressure roller, by means of which the pressure roller is pressed onto the bobbin circumference. Thus, the pair of winding delivery rollers always lies at the same distance from the bobbin outer circumference and does not need to be guided separately. The bearing pressure may be generated via a restoring element, such as, for example, a spring, or by an actively applied force.

Furthermore, the pressure cylinder of the pair of winding delivery rollers may be connected pivotably to the first guide means via second guide means. Moreover, preferably, means are provided which exert a restoring force, via the second guide means, on the pressure cylinder and press the latter onto the lower roller of the pair of winding delivery rollers, at the same time exerting a defined pressure force. The restoring means may be, for example, a spring or other force-applying means.

The pressure roller is preferably a press roller, in particular a drive or tacho roller at the roving bobbin. The press roller is preferably coupled mechanically to the pair of winding delivery rollers via a guide arm.

According to an alternative embodiment, the pressure roller is coupled via the first guide means to the pair of winding delivery rollers in such a way that, with the lower or the upper roller of the pair of winding delivery rollers, it forms a common axis of rotation, that is to say they are mounted coaxially. In this case, the press roller has a larger diameter than the lower or the upper roller of the pair of winding delivery rollers with the same axis of rotation and performs the function of a spacer roller. A plurality of pressure rollers, such as, for example, two pressure rollers with the lower or the upper roller mounted coaxially between them, may also be provided. According to this version, the pressure roller may also serve for measuring the circumferential speed of the roving bobbin, that is to say in its function as a tacho roller.

The invention relates, furthermore, to an apparatus for producing a roving, which is distinguished by a winding device according to the invention. The roving production apparatus contains a drafting arrangement, for example an apron drafting arrangement, with at least one driven pair of main drafting rollers. The drafting arrangement has, furthermore, after the pair of main drafting rollers, a pair of exit rollers (delivery rollers), via which the sliver is supplied from the drafting arrangement to the twist-generating device. The drafting arrangement may, under certain circumstances, have a pneumatic or mechanical condensing device following the drafting zones.

The drafting arrangement is preferably a double-apron drafting arrangement of the known type, with a pair of main drafting rollers, around which in each case an upper and a lower apron are guided, and also a pair of exit rollers. An apron-guided main drafting zone is formed between the two pairs of rollers. Furthermore, the drafting arrangement may contain a pair of entry rollers preceding the pair of main drafting rollers. A pre-drafting zone is then formed between the pair of entry rollers and the pair of main drafting rollers. The pair of entry rollers, the pair of main drafting rollers and the pair of exit rollers may be driven by means of joint or individual drives independent of one another. Preferably, the pair of main drafting rollers is driven independently of the pair of exit rollers. If a pair of entry rollers is provided, the pair of entry rollers and the pair of main drafting rollers may be driven by means of a common drive. However, the pair of exit rollers and the pair of main drafting rollers may also be driven via a common drive. A common drive is correspondingly connected via at least one gear to one of the pairs of rollers.

As already mentioned, the roving production apparatus contains a twist-generating device with a twist-generating member. The twist-generating device may be an airjet twist-generating assembly with a vortex chamber according to WO-A-2005/026421, an air jet twist-generating assembly with two vortex chambers according to WO-A-2004/042126 or a twist-generating device with a pneumatic or mechanical false-twist element and with a following self-twine device according to Swiss Patent Application CH 00044/08.

A driven pair of take-off rollers is preferably provided after the twist-generating device. The pair of take-off rollers may be driven independently, that is to say individually. However, the pair of take-off rollers may also be driven, together with the pair of exit rollers, via a common drive. A common drive is correspondingly connected via at least one gear to one of the pairs of rollers.

Between the pair of take-off rollers and the traversing device, a roving buffer may be provided, which intermediately stores a roving surplus between the roving delivery by the pair of take-off rollers and the roving take-up by the winding device. Such intermediate storage may be expedient, for example, within the framework of a piecing process in which the rotational speeds of the individual drive motors first also have to be adjusted. Furthermore, in the case of a bobbin change, roving intermediate storage may likewise be desirable, so that, in spite of an interruption in the winding of the roving, roving production can be continued at the same or at a reduced speed. It goes without saying that roving storage may also be expedient in the event that the roving delivery and roving winding drift apart temporarily. Any roving intermediate store can be regulated via the primary control loop described below.

Moreover, a roving tension sensor may be provided between the pair of take-off rollers and the pair of winding delivery rollers. The periodically or continuously measured roving tension may be used for regulating the roving intermediate store and/or the speed of the pair of winding delivery rollers and of the roving bobbin.

The roving production apparatus may provide, for regulating the roving winding, a common primary control loop for the drafting arrangement drives, for the drive of the pair of take-off rollers, and for the drive of the bobbin drive. In a preferred further development of the invention, one of the drive motors coupled to the control loop assumes the position of a master drive motor. The remaining drive motors coupled to the control loop assume the position of slave drive motors, the drive motor of the pair of winding delivery rollers preferably being a slave drive motor. The master drive motor is preferably a drafting arrangement drive motor, in particular that drive motor which drives the pair of main drafting rollers. The drive of the pair of winding delivery rollers may likewise be part of this control loop, in which case this drive would likewise be a slave. However, as described below, the drive of the pair of winding delivery rollers may also be part of a secondary control loop subordinate to the abovementioned control loop. This secondary control loop regulates the roving tension between the pair of winding delivery rollers and the roving bobbin. Roving tension regulation is referred to below in this context.

The roving tension between the pair of winding delivery rollers and the roving bobbin assumes major importance. To achieve as high a packing density as possible on the roving bobbin, the roving should be deposited with as high a tension as possible on the bobbin, so that the roving is wound as tautly as possible onto the bobbin. On the other hand, the roving tension should not be too high so that wrong drafts or roving breaks do not occur. Furthermore, the roving tension should remain as constant as possible, so that wrong drafts do not occur. Basically, any increased tension in the roving leads to a certain drafting behaviour. These drafts occurring during the winding are basically not a problem as long as they remain constant and the roving treated in the following spinning machine acquires a uniform mass distribution. However, if the roving tension at the winding point changes repeatedly and markedly, different drafts occur, what are known as wrong drafts, in the roving, thus giving rise to an irregular mass distribution in the roving which is reflected in irregularity in the final yarn.

It is also sufficient to regulate the rotational speed of the pair of winding delivery rollers by means of the primary control loop or by means of the bobbin rotational speed.

Roving tension regulation at the winding unit therefore has the task, on the one hand, of maintaining a specific tension level, so that a firm roving bobbin of high density is obtained, and, on the other hand, of ensuring a constant roving tension, in that distinctive tension changes in the roving are adjusted promptly by a change in the delivery speed of the pair of winding delivery rollers.

As mentioned, roving tension regulation takes place via the drive of the pair of winding delivery rollers, called the delivery roller drive below, which is preferably a torque-dependent drive. Regulation is based on detecting the drive torque $M_{An}$ of the delivery roller drive. This is therefore what is known as torque regulation. The drive torque $M_{An}$ is composed of the air friction $M_{Lu}$ which the driven pair of rollers experiences, of the bearing resistance $M_{La}$, of the flexing resistance $M_{Wa}$ between the upper and the lower roller and of the tension of the running-in slubbing $M_{Lu\text{-}Einl}$. Further system-related resistances not specified in any more detail at this juncture are designated by $M_{Wi}$. The above-mentioned variables, which have a braking action on the system and therefore have to be overcome by the drive torque $M_{An}$, are counteracted by the slubbing tension of the running-out slubbing $M_{Lu\text{-}Ausl}$ which exerts a relieving action on the system. This therefore gives rise to the following torque equation:

$$M_{An}=M_{Lu}+M_{La}+M_{Wa}+M_{Wi}+M_{Lu\text{-}Einl}+M_{Lu\text{-}Ausl}$$

where $M_{An}$ and $M_{Lu\text{-}Ausl}$ are driving torques and $M_{Lu}$, $M_{La}$, $M_{Wa}$, $M_{Wi}$ and $M_{Lu\text{-}Einl}$ are braking torques.

The torques $M_{Lu}$, $M_{La}$, $M_{Wa}$ and $M_{Wi}$ are variables which are independent of the roving guide and which are determined by referencing during the idling of the pair of winding delivery rollers, if appropriate as a function of the rotational speed, and are incorporated as fixed variables into the equation. The only variables remaining are the tension of the running-in slubbing $M_{Lu\text{-}Einl}$ and that of the running-out slubbing $M_{Lu\text{-}Ausl}$. To determine the torque $M_{Lu\text{-}Ausl}$, therefore, only the tension of the running-in slubbing needs to be known. This may take place, for example, by means of a tension sensor upstream of the entry into the pair of winding delivery rollers. However, since it will be beneficial to dispense with tension sensors for regulation reasons, it is preferable to provide, upstream of entry into the pair of winding delivery rollers, a device which ensures as constant a roving tension as possible at the entry into the pair of winding delivery rollers.

Such a device could, for example, be in the form of a device for sag regulation. Such a device deflects the roving, before the latter runs into the pair of winding delivery rollers, out of its conveying direction so as to form a loop. The deflection force may, for example, be generated pneumatically and/or by gravity or otherwise. Any changes in the roving tensions are compensated in the sag, so that the roving runs with constant tension to the pair of winding delivery rollers. The device may, for example, be combined with a roving store. Furthermore, the device may also comprise a jockey bar or jockey arm known in winding machines. The roving is in this case led via the jockey arm or jockey bar loaded with a torque. A sag is thereby generated in the roving between two roving guides.

The, for example, spring-loaded jockey arm or jockey bar deflects the roving transversely to its running direction and at the same time keeps it under tension. Owing to the torque load on the jockey arm or jockey bar, the roving loop produced then automatically becomes larger if more roving than is wound is delivered. Conversely, the roving store is capable of also dispensing the roving again, as required. As a result, in spite of a different roving delivery or in spite of a change in roving tension, a constant roving tension is achieved, downstream of the nozzle outlet, upon entry into the pair of winding delivery rollers. Furthermore, the tension fluctuations caused during the traversing of the roving as a result of path changes in the run of the roving are also compensated.

It is advantageous, furthermore, if the roving tension upon entry is as low as possible, that is to say is near to zero or lower at least by a factor 2 to 10 than upon exit. Thus, the roving tension or its variability upon entry into the nip line is less important in the torque calculation and the regulation of the roving tension upon exit becomes more accurate.

If, then, the roving tension at the entry of the pair of winding delivery rollers is known or constant, then, by determining the load moment, a change in the roving tension after exit from the pair of winding delivery rollers can be determined. The load moment may be determined, for example, by detecting the deviation of the rotor position in the drive motor or on the basis of the current consumption of the drive motor.

As soon as the roving tension upon exit increases, then, for example due to the rise in the bobbin rotational speed, the torque $M_{Lu\text{-}Ausl}$ becomes higher and the delivery roller drive is relieved. The torque regulation then ascertains, via the load moment, that the torque $M_{An}$ decreases and consequently an increase in the roving tension at the exit takes place. Regulation then increases the rotational speed of the delivery roller drive, so that the roving tension at the exit decreases again and the torque $M_{An}$ resumes its desired value.

The delivery roller drive may, for example, be a BLDC (brushless direct-current motor), or a synchronous, asynchronous or a synchronous/asynchronous motor. The said motors may be designed as servomotors. Servomotors may also be designed as stepping motors. A BLDC motor may, for example, be equipped with a Hall sensor for determining the rotor position.

Synchronous and BLDC motors require a software-based application of the behaviour via the detection of the torque by means of the rotor position by a known method, for example Hall sensors, measurement of the zero passage of the third harmonic, and corresponding control algorithms.

The torque-dependent drive of the delivery roller drive may, by contrast, be self-regulating if it is an asynchronous motor. This is carried out by rating it in terms of a suitable characteristic of the rotational-speed/torque characteristic curve. A current of a specific frequency is stipulated here for the asynchronous motor according to a stipulated desired rotational speed. In the case of an increase in the roving tension, the motor is under traction, that is to say is relieved, and the rotational speed increases. However, in the case of an increase in the rotational speed, the roving tension is reduced again, since the speed difference between the delivery roller drive and the bobbin drive decreases. Conversely, in the case of a decrease in the roving tension during run-out, the motor load increases and the rotational speed of the motor decreases. However, the decrease in the delivery roller rotational speed causes an increase in the roving tension, since the speed difference between the delivery roller drive and the bobbin drive increases. Thus, the asynchronous motor adjusts itself in the case of a specific rotational speed, that is to say to a specific torque equilibrium.

Further, the invention also comprises a method for producing a roving, using the roving production apparatus according to the invention. The method is distinguished in that one of the drives coupled to the primary control loop assumes the position of a master drive motor and the remaining drive motors coupled to the control loop assume the position of slave drive motors, the drive motor of the pair of the winding delivery rollers being a slave drive motor, and in that the variable rotational speed of the master drive motor or the production speed is the controlled variable in the control loop.

The rotational speeds of the drive motor of the pair of winding delivery rollers and of the bobbin drive motor are preferably coordinated with one another via the secondary control loop in such a way that a constant roving tension is established between the nip line and the winding point on the roving bobbin, or in such a way that the roving tension ranges at least always within a predetermined bandwidth.

BRIEF DESCRIPTION OF THE DRAWINGS

The invention is explained in more detail below with reference to drawings in which.

DETAILED DESCRIPTION

Figure 1:
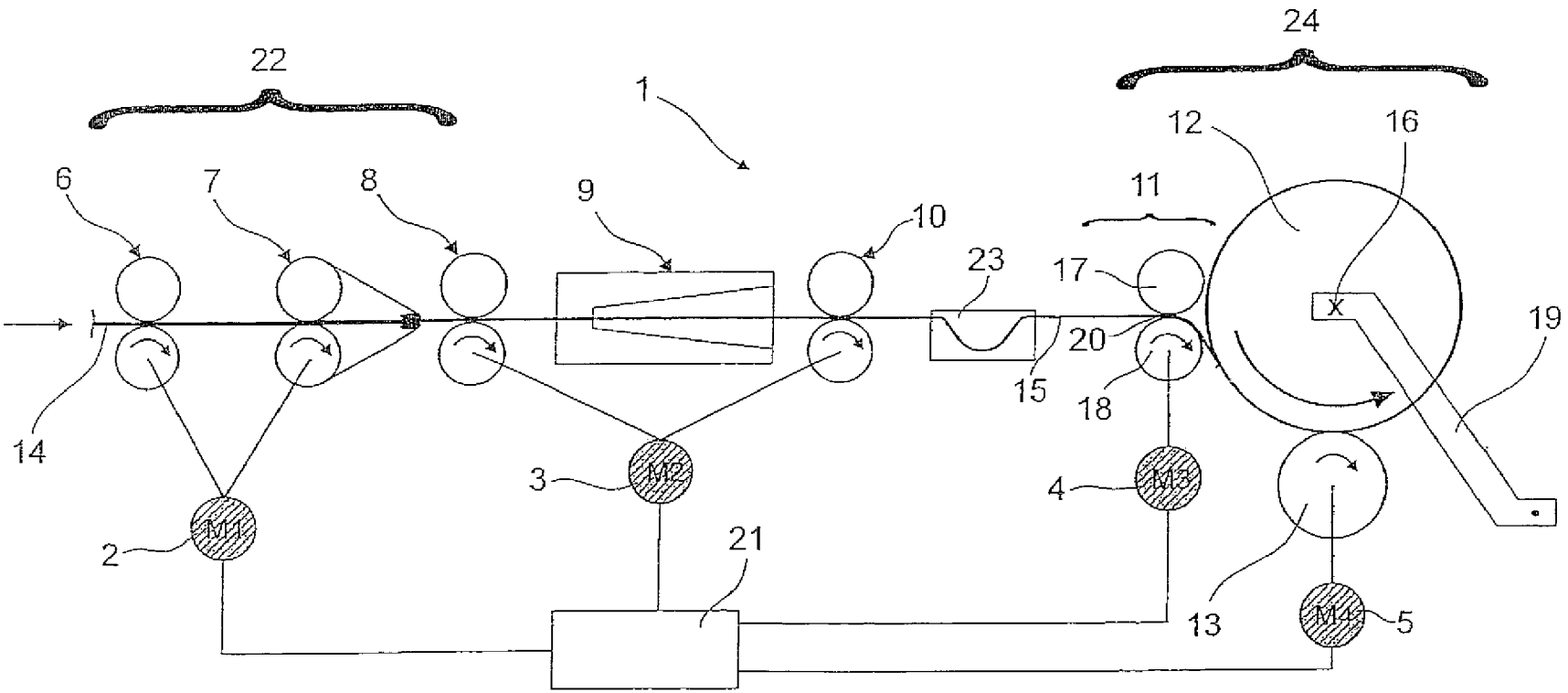
FIG. 1: shows a diagrammatical illustration of a spinning station in cross section.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows diagrammatically a spinning station 1 of a roving machine (the entire roving machine is not shown) according to the invention. This possible embodiment of the invention has a drafting arrangement 22 (likewise illustrated diagrammatically) which is supplied with a fibre composite 14 (for example, a doubled draw sliver). The drafting arrangement 22 is a double-apron drafting arrangement with a pair of entry rollers 6 and with a pair of main drafting rollers 7, between which a pre-drafting zone is formed. An upper and a lower apron are looped in each case around the rollers of the pair of main drafting rollers 7 and are deflected at a deflection bridge in the fibre flow direction.

The pair of entry rollers 6 and the pair of main drafting rollers 7 or the associated lower rollers are driven by a common drive 2. The lower rollers are connected to the drive 2 via gears (not shown).

The main drafting zone is formed between the pair of main drafting rollers 7 and a pair of exit rollers 8 following in the fibre flow direction. The drafted fibre composite 14 passes from the drafting arrangement 22 into the twist-imparting device 9. In the twist-imparting device 9, the fibre composite 14 is twisted into a roving 15, that is to say a genuine twist is imparted to the fibre composite at least partially (that is to say, to at least some of the fibres of the fibre composite). Furthermore, FIG. 1 shows a pair of take-off rollers 10 with a nip line and a winding apparatus 24 (likewise illustrated diagrammatically) for the roving 15. The pair of exit rollers 8 and the pair of take-off rollers 10 or the associated lower rollers are driven by a common drive 3. The lower rollers are connected to the drive 3 via gears (not shown).

The twist-imparting device 9 operates according to what is known as the vortex method, a special airjet spinning method. Airjet spinning methods are already known per se as yarn-spinning methods, but it has been known for only a short time that a modified vortex method is also suitable for the production of vortex roving.

The twist-imparting means according to the invention have to impart only a protective twist to the fibre composite, in contrast to conventional airjet spinning apparatuses, to ensure that the stubbing or roving thereby formed remains draftable. This protective twist is such that the roving remains draftable for the further treatment process and the imparting of the twist may, if appropriate, even be cancelled. It therefore is or would be reversible, in contrast to the twist which would be imparted to a fibre composite by means of conventional, that is to say known, airjet spinning apparatuses. To form the roving, a genuine twist is imparted to the fibre composite at least partially, that is to say at least some of the fibres of the fibre composite, if not all, acquire a genuine twist (twist) by means of an airflow. This genuine twist or twist is only a protective twist, as mentioned. The roving or slubbing produced according to the invention therefore has the same function as and similar properties to a slubbing produced by means of a conventional flyer.

The winding apparatus 24 is illustrated only diagrammatically in FIG. 1. This comprises a traversing device 11 arranged directly in front of the roving bobbin 12 and having a pair of winding delivery rollers 17, 18 traversable in the axial direction 16 of the roving bobbin and consisting of an upper roller 17 and lower roller 18 which form a nip line 20 through which the roving 15 is guided. The pair of rollers 17, 18 or the lower roller 18 is driven by a drive 4. The winding apparatus may be a cross winder, a precision cross winder, a random cross winder, a stepped precision winder or a parallel winder.

The roving bobbin 12 is mounted in a bobbin mounting 19 which is designed to be pivotable, for example, for the purpose of a bobbin change. The roving bobbin 12 is driven via a winding roller 13 which, in turn, is driven by a drive motor 5. Between the pair of take-off rollers 10 and the pair of delivery rollers 17, 18 is arranged a roving buffer 23 which has a roving store. The roving store may comprise, for example, a suction device, via which the roving can be deflected so as to form a loop, while at the same time covering a longer distance.

The drives 2, 3, 4 and 5 and the roving buffer 23 are connected to a common control loop 21. The drive 2 of the pair of main drafting rollers is designed as a master drive, while the remaining drives have the status of slave drives.

Master drive means that the variable rotational speed of this drive 2 is incorporated as a controlled variable into the control loop, and the remaining drives are adjusted according to this controlled variable which, in principle, is a measure of the production speed, so that, between roving production and roving winding, a dynamic equilibrium is established which is distinguished by a controlled, in particular controlled constant roving tension. The drive 4 is additionally torque-regulated via a secondary control loop of the type described above. Torque regulation is preferably used, in most general terms, when production has been run up and is running at a constant level. During the run-up and also the run-down of the machine, torque regulation may be dispensed with for regulation reasons.

Figure 2B:
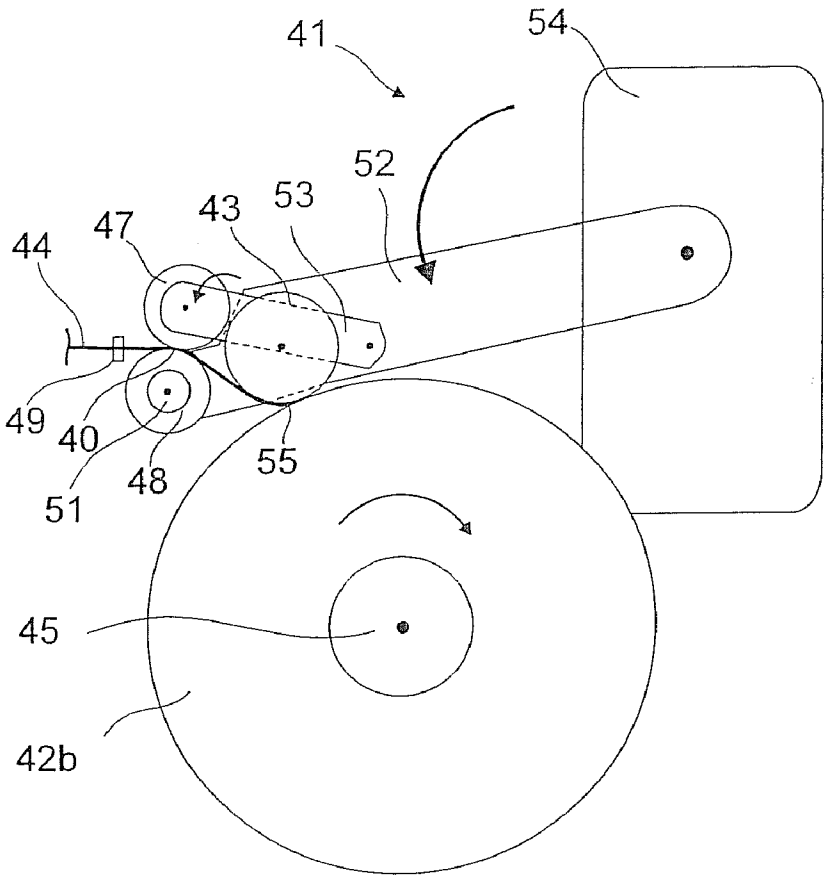
FIG. 2*b*: shows a cross-sectional view of a winding device in a second winding position.
Figure 2A:
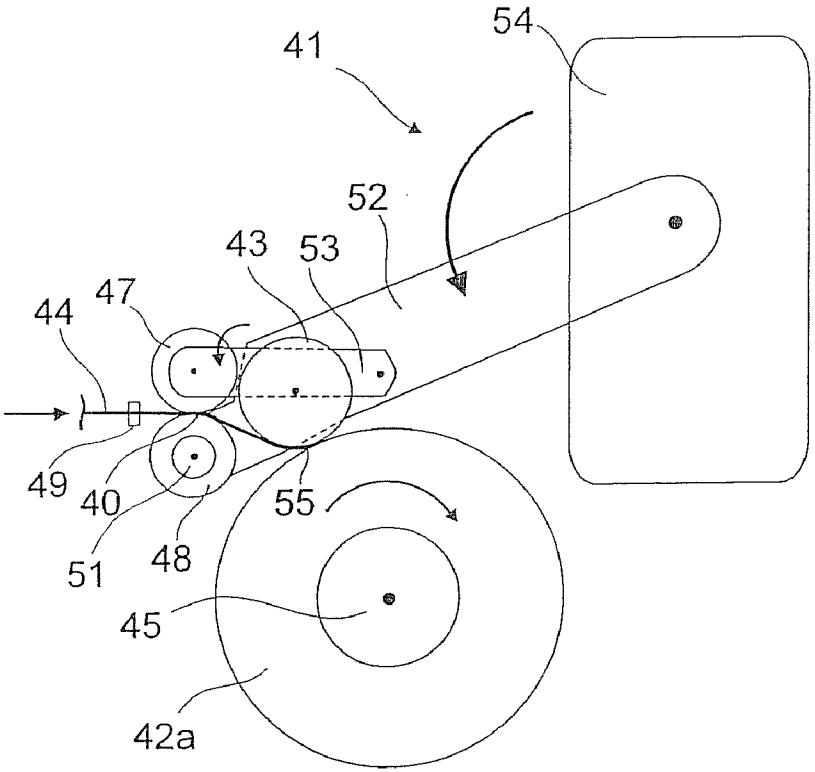
FIG. 2*a*: shows a cross-sectional view of a winding device in a first winding position.

FIGS. 2*a* and 2*b* show a cross section through a winding device 41 with a roving bobbin 42*a*, 42*b*, of which the shaft forming the axis of rotation is driven directly by the drive 45. A tacho roller 43, which has to fulfil two tasks, lies on the roving bobbin 42*a*, 42*b*. The first task is to determine the circumferential speed of the roving bobbin 42*a*, 42*b*. For this purpose, the rotational speed of the tacho roller 43 is detected via corresponding sensor means and evaluated. The second task is based on always guiding the pair of winding delivery rollers 47, 48 at a uniform distance from the outer circumference of the roving bobbin 42*a*, 42*b* in spite of a changing outer circumference of the roving bobbin 42*a*, 42*b*. For this purpose, the pair of winding delivery rollers 47, 48 and the tacho roller 43 are rotatably mounted on common first guide means in the form of a pivoting arm 52. The pivoting arm 52 is mounted pivotably with respect to the roving bobbin 42*a*, 42*b*, so that, in the case of an increase in the bobbin circumference, the tacho roller can be displaced approximately in the radial direction. The pivoting arm 52 is designed to be rigid, so that the approximately radial movement of the tacho roller 43 is also transmitted to the pair of winding delivery rollers 47, 48 in the case of an increase in bobbin circumference. The pivoting arm 52 is mounted pivotably via a device 54. Restoring means (arrow) which act on the pivoting arm 52 press the tacho roller 43 against the outer circumference of the roving bobbin 42*a*, 42*b*. The pivoting arm 52, of course, executes a circular movement. The movement of the tacho roller 43 with respect to the roving bobbin 42*a*, 42*b* may nevertheless, seen in small steps, be considered as a radial movement.

The pressure cylinder 47 of the pair of winding delivery rollers 47, 48 is mounted rotatably on second-guide means in the form of a second pivoting arm 53 and is pressed via these onto the lower roller 48. The pressure force necessary for this purpose on the lower roller 48 is exerted on the pivoting arm 53 via restoring means (arrow). The second pivoting arm 53 is mounted pivotably on the first pivoting arm 52.

The lower roller 48 of the pair of winding delivery rollers 47, 48 is driven via a drive 51. Furthermore, the pair of winding delivery rollers 47, 48 is preceded by a thread-laying device (traversing device) 49, by means of which the roving 44 to be laid is traversed along the bobbin axis of rotation.

The roving is drawn through the nip line 40 of the pair of winding delivery rollers 47, 48 and supplied to the winding point 55 at which the roving 44 is laid onto the bobbin. The winding point 55 is formed here by the nip line between the tacho roller 43 and roving bobbin 42*a*, 42*b*. As illustrated in FIG. 2*a*, 2*b*, the roving 44 may be looped around part of the circumference of the lower roller 48 and the tacho roller 43. Thus, the free path length of the roving 44 between the nip line 40 and the winding point 55, which path length is to be as short as possible on account of possible wrong drafts, is shortened.

FIG. 2*b* shows the displacement of the tacho roller 43 and the deflection of the pivoting arm 52 in the case of an increasing bobbin circumference with respect to FIG. 2*a*.

It should be appreciated by those skilled in the art that various modifications and variations may be made present invention without departing from the scope and spirit of the invention. It is intended that the present invention include such modifications and variations as come within the scope of the appended claims.

The invention claimed is:

1. An apparatus for winding a roving onto a roving bobbin, comprising:

a twist-generating device, and a pair of take-off rollers downstream of said twist-generating device;

a bobbin mounting configured for rotation of a roving bobbin;

a roving laying device configured for laying the roving onto said roving bobbin;

said take-off rollers disposed upstream of said roving laying device;

said roving laying device further comprising a pair of winding delivery rollers with at least one of said winding delivery rollers being a driven roller, said winding delivery rollers disposed directly adjacent to said roving bobbin and defining a nip line through which the roving travels as it traverses along an axial direction of said roving bobbin as the roving is wound onto said roving bobbin, said winding delivery rollers; and wherein rotational speed of said winding delivery rollers is regulated to achieve a controlled specific tension in the roving laid on said roving bobbin.

2. The apparatus as in claim 1, wherein said winding delivery rollers are traversable along said axial direction of said roving bobbin for traversely winding the roving onto said roving bobbin.

3. The apparatus as in claim 1, wherein said roving laying device further comprises a traversing member disposed either preceding or following said winding delivery rollers in a direction of travel of the roving, said traversing member configured for traversing the roving along said nip line of said winding delivery rollers.

4. The apparatus as in claim 1, further comprising a drive configured with said winding delivery rollers and a drive configured with said roving bobbin, said drives connected to a control loop that regulates roving tension of the roving between said winding delivery rollers and said roving bobbin.

5. The apparatus as in claim 4, wherein regulation of said control loop is torque dependent as a function of torque of said drive for aid winding delivery rollers or said drive for said roving bobbin.

6. The apparatus as in claim 1, further comprising a pressure roller disposed to bear against said roving bobbin, said pressure roller configured on a pivotal first guide so as to move with increasing size of said roving bobbin, said winding delivery rollers also operably configured on said pivotal first guide so as to also move with said pressure roller as said roving bobbin increases in size.

7. The apparatus as in claim 6, further comprising a restoring device configured with said pressure roller to bias said pressure roller against said roving bobbin.

8. An apparatus for winding a roving onto a roving bobbin, comprising:

a bobbin mounting configured for rotation of a roving bobbin;

a roving laying device configured for laying the roving onto said roving bobbin;

said roving laying device further comprising a pair of winding delivery rollers with at least one of said winding delivery rollers being a driven roller, said winding delivery rollers disposed directly adjacent to said roving bobbin and defining a nip line through which the roving travels as it traverses along an axial direction of said roving bobbin as the roving is wound onto said roving bobbin;

a pressure roller disposed to bear against said roving bobbin, said pressure roller configured on a pivotal first guide so as to move with increasing size of said roving bobbin, said winding delivery rollers also operably configured on said pivotal first guide so as to also move with said pressure roller as said roving bobbin increases in size; and wherein one of said winding delivery rollers is a pressure roller that is rotatably mounted on a second guide, said second guide pivotably mounted to said first guide.

9. The apparatus as in claim 8, further comprising a restoring device configured with said second guide so as to bias said pressure roller onto the other of said winding delivery rollers.

10. The apparatus as in claim 1, further comprising a drafting arrangement having at least one pair of main drafting rollers, a pair of exit rollers downstream of said main drafting rollers, said twist-generating device disposed downstream of said exit rollers.

11. The apparatus as in claim 10, further comprising respective drives for said drafting arrangement, said take-off rollers, said winding delivery rollers, and said roving bobbin, said respective drives operably connected to a common control loop.

12. An apparatus for winding a roving onto a roving bobbin, comprising:

a bobbin mounting configured for rotation of a roving bobbin;

a roving laying device configured for laying the roving onto said roving bobbin;

said roving laying device further comprising a pair of winding delivery rollers with at least one of said winding delivery rollers being a driven roller, said winding delivery rollers disposed directly adjacent to said roving bobbin and defining a nip line through which the roving travels as it traverses along an axial direction of said roving bobbin as the roving is wound onto said roving bobbin;

a drafting arrangement having at least one pair of main drafting rollers, a pair of exit rollers downstream of said main drafting rollers, a twist-generating device downstream of said exit rollers, and a pair of take-off rollers downstream of said twist-generating device, said take-off rollers disposed upstream of said roving laying device;

respective drives for said drafting arrangement, said take-off rollers, said winding delivery rollers, and said roving bobbin, said respective drives operably connected to a common control loop; and wherein one of said respective drives is a master drive motor and the remaining respective drives are slave drive motors wherein control of said slave drive motors via said common control loop is a function of said master drive motor, and wherein said drive motor for said winding delivery rollers is one of said slave drive motors.

13. The apparatus as in claim 12, wherein said slave drive motors are controlled as a function of variable rotational speed of said master drive motor.

14. The apparatus as in claim 12, wherein said slave drive motors are controlled as a function of roving production speed of said apparatus.

15. The apparatus as in claim 12, wherein said drive motor for said drafting arrangement is said master drive motor.

16. The apparatus as in claim 10, further comprising a roving buffer operably disposed between said take-off rollers and said roving-laying device.

* * * * *